US010907378B2

(12) United States Patent
Su

(10) Patent No.: US 10,907,378 B2
(45) Date of Patent: Feb. 2, 2021

(54) LOCK FOR ELECTRONIC DEVICES

(71) Applicant: Jason Su, Changhua (TW)

(72) Inventor: Jason Su, Changhua (TW)

(73) Assignee: INGAMAR CO., LTD., Changhua (TW)

( * ) Notice: Subject to any disclaimer, the term of this patent is extended or adjusted under 35 U.S.C. 154(b) by 269 days.

(21) Appl. No.: 16/247,999

(22) Filed: Jan. 15, 2019

(65) Prior Publication Data

US 2020/0224451 A1 Jul. 16, 2020

(51) Int. Cl.
*E05B 17/20* (2006.01)
*E05B 73/00* (2006.01)

(52) U.S. Cl.
CPC ..... *E05B 17/2015* (2013.01); *E05B 73/0005* (2013.01); *E05B 73/0082* (2013.01)

(58) Field of Classification Search
CPC ..... E05B 17/2015; E05B 73/0005; E05B 73/0082; E05B 73/00
USPC ..... 70/14, 18, 19, 30, 49, 57, 58; 248/551–553; 361/679.57, 679.58
See application file for complete search history.

(56) References Cited

U.S. PATENT DOCUMENTS 8,505,344 B2 * 8/2013 Su ..... E05B 73/0082 70/58
9,137,911 B2 * 9/2015 Avganim ..... H05K 5/0208
9,784,019 B2 * 10/2017 Avganim ..... G06F 1/1633
10,378,249 B1 * 8/2019 Lee ..... E05B 73/0082
2008/0105007 A1 * 5/2008 Tracy ..... E05B 73/0005 70/58
2013/0180295 A1 * 7/2013 Avganim ..... E05B 73/0082 70/58
2014/0366593 A1 * 12/2014 Avganim ..... E05B 73/0005 70/58
2015/0059422 A1 * 3/2015 Kao ..... E05B 73/00 70/58
2018/0363334 A1 * 12/2018 Wu ..... E05B 73/0082
2019/0112840 A1 * 4/2019 Wu ..... E05B 73/0082
2019/0226243 A1 * 7/2019 Lee ..... E05B 73/0082
2020/0173201 A1 * 6/2020 Avganim ..... E05B 73/0005
2020/0173202 A1 * 6/2020 Avganim ..... E05B 37/02
2020/0173203 A1 * 6/2020 Avganim ..... E05B 73/0005
2020/0181950 A1 * 6/2020 Su ..... E05B 37/02
2020/0181951 A1 * 6/2020 Su ..... E05B 73/0082

* cited by examiner

*Primary Examiner* — Lloyd A Gall
(74) *Attorney, Agent, or Firm* — Che-Yang Chen; Law Office of Michael Chen

(57) ABSTRACT

A lock for electronic devices may include a main body, a lock barrel, a connecting member, a first engaging member, and a second engaging member. The main body has a shell which comprises two pieces to fit together, and at least an inner surface of the shell has a first housing and a second housing which are communicated through a connecting channel. Two ends of the shell respectively have a first opening and a second opening axially penetrating through the shell, and the second housing comprises a first securing portion formed therein. The main body is connected to a lock cable which is configured to be wound around an immovable object to achieve the burglarproof effect of the lock.

10 Claims, 7 Drawing Sheets

LOCK FOR ELECTRONIC DEVICES

FIELD OF THE INVENTION

The present invention relates to a lock, and more particularly to a lock for electronic devices such as notebook, laptop and tablet.

BACKGROUND OF THE INVENTION

Nowadays, the electronic devices such as notebook, laptop and tablet become lighter, thinner and smaller, and because of easily carried place to place, they are becoming desirable targets for thieves. Therefore, there remains a need for a new and improved design for a lock for electronic devices to overcome the problems presented above.

SUMMARY OF THE INVENTION

The present invention provides a lock for electronic devices which comprises a main body, a lock barrel, a connecting member, a first engaging member, and a second engaging member. The main body has a shell which comprises two pieces to fit together, and at least an inner surface of the shell has a first housing and a second housing which are communicated through a connecting channel. Two ends of the shell respectively have a first opening and a second opening axially penetrating through the shell, and the second housing comprises a first securing portion formed therein. The main body is connected to a lock cable which is configured to be wound around an immovable object to achieve the burglarproof effect of the lock. The lock barrel is installed in the first housing of the main body, and the lock barrel comprises a lock bolt which is adapted to axially protrude from the first opening to stick out of the shell when the lock is at an unlocked position. The connecting member has a base, and an ear portion is formed at an end of the base, and an elongated pivot hole vertically penetrates through the ear portion. The connecting member is positioned in the connecting channel of the shell, and the base is connected to the lock bolt in the connecting channel. The first engaging member has a first section and a second section which are connected together to form a designed angle bend, and the first section comprises a second securing portion thereon. When the first engaging member is positioned in the shell, the second securing portion is connected to the first securing portion so as to connect the first section of the first engaging member into the second housing, and the second section is configured to protrude from the second opening to stick out of the shell. The second section has a gradually larger diameter outwardly from the shell, and a lateral surface of the second section close to the second engaging member comprises a guiding portion, and an engaging block is adapted to protrude from the other lateral surface of the second section. The second engaging member comprises a connecting portion which is configured to pivotally connect to the pivot hole of the connecting member in the connecting channel. Also, a lock rod protrudes from an end of the connecting portion, and the lock rod is located a position deviated away from a central axis of the connecting portion. Moreover, a lateral edge of the lock rod close to the first engaging member comprises a driven portion which is coupled with the guiding portion of the first engaging member such that the lock rod is adapted to be driven by the lock bolt and moved along the lateral surface of the second section which is close to the second engaging member. Thus, the lock rod is adapted to be moved by the lock bolt to protrude from or back in the second opening so as to achieve locking and unlocking effects.

Comparing with conventional 3C devices lock, the present invention is advantageous because: (i) the lock of the present invention can be used for the electronic devices having the rectangle lock hole or the fishtail lock hole; and (ii) the lock will not affect the use of the electronic devices, and it is easy for a user to operate between the locked and unlocked positions.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

Figure 1:
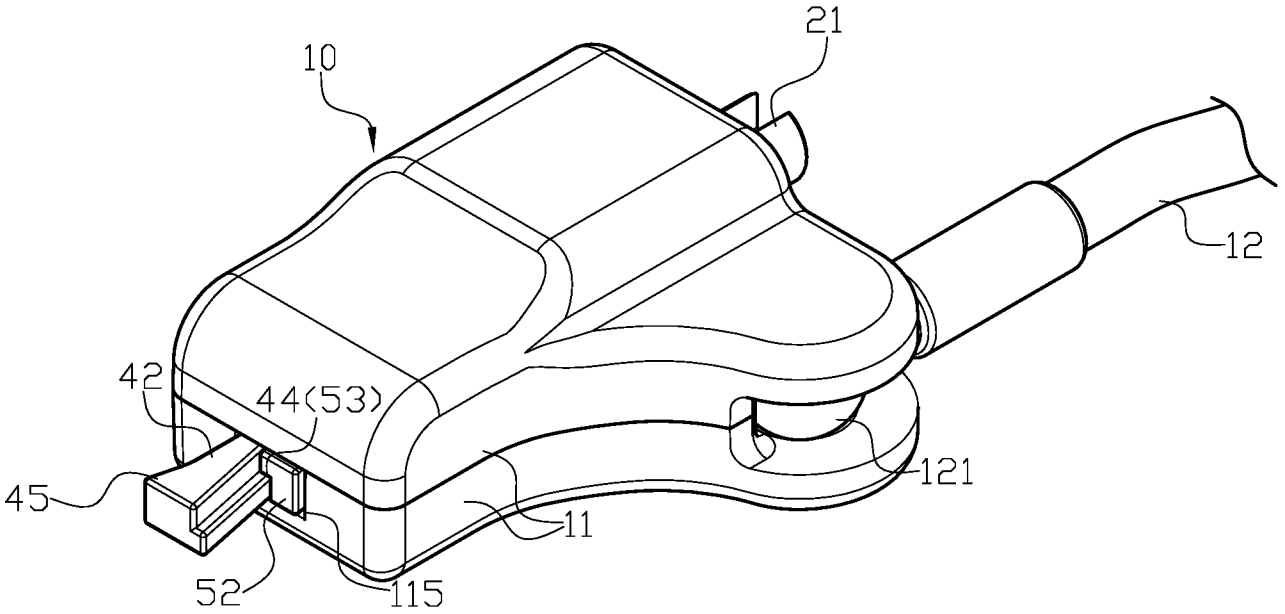
FIG. 1 is a three-dimensional assembly view of a lock for electronic devices in the present invention.
Figure 2:
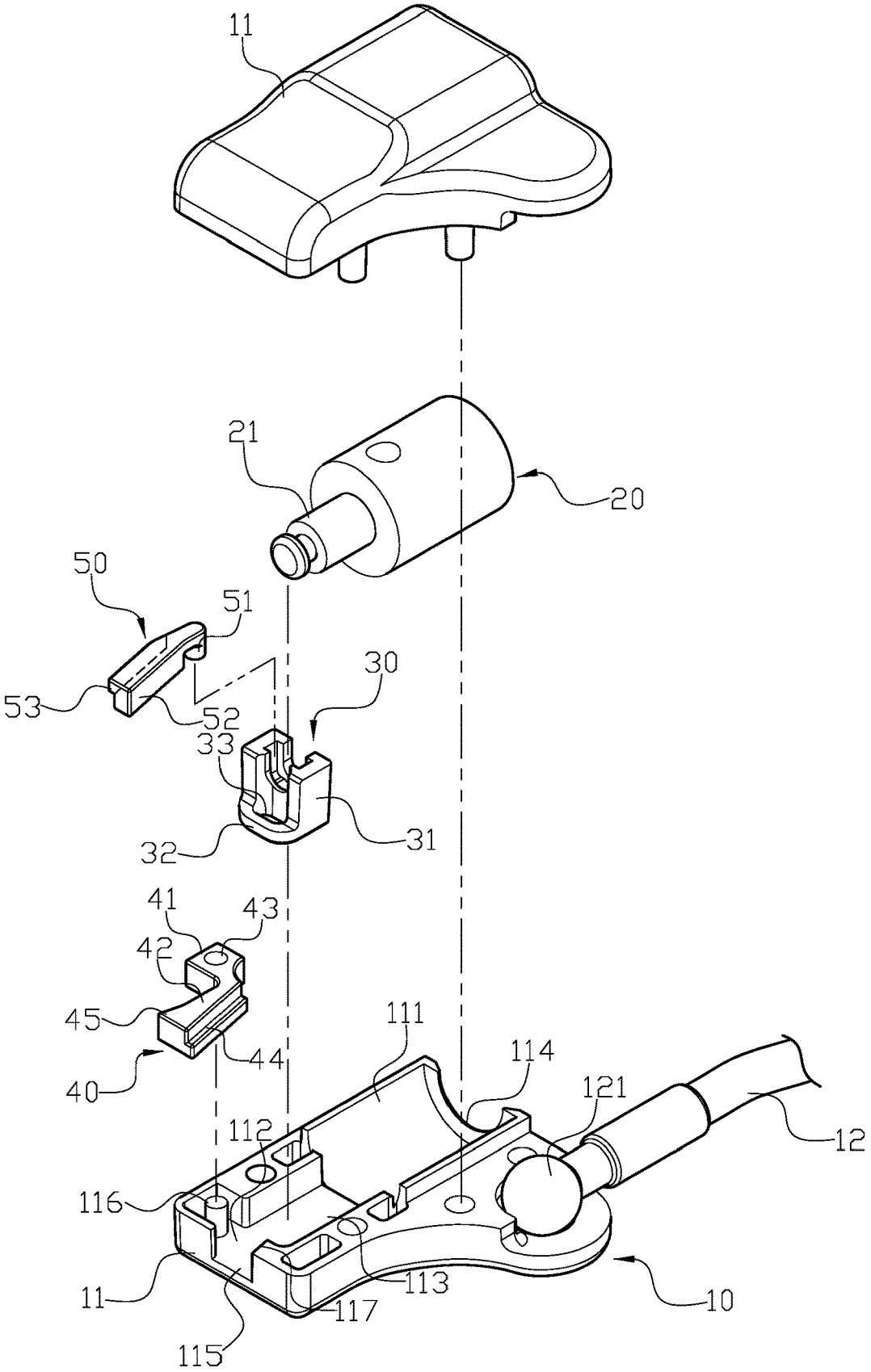
FIG. 2 is a three-dimensional exploded view of the lock for electronic devices in the present invention.
Figure 3:
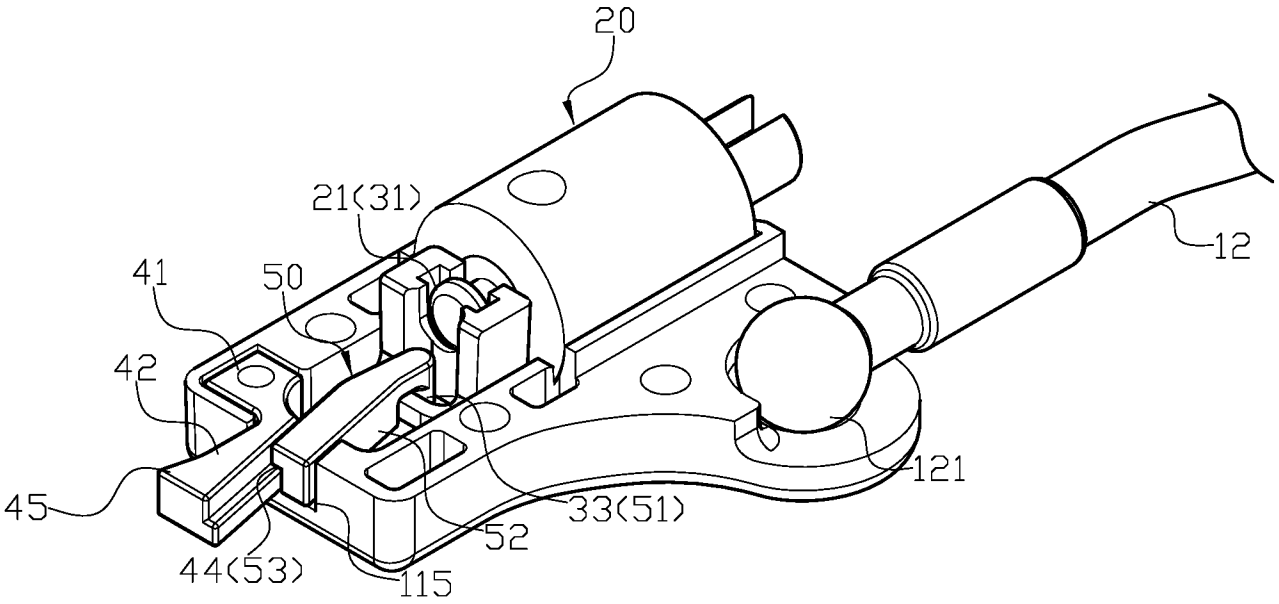
FIG. 3 is a three-dimensional view illustrating a second engaging member of the lock is positioned in a second opening in the present invention.

In order to further understand the goal, characteristics and effect of the present invention, a number of embodiments along with the drawings are illustrated as following:

Referring to FIGS. 1 to 3, the present invention provides a lock for electronic devices which comprises a main body (10), a lock barrel (20), a connecting member (30), a first engaging member (40), and a second engaging member (50). The main body (10) has a shell (11) which comprises two pieces to fit together, and at least an inner surface of the shell (11) has a first housing (111) and a second housing (112) which are communicated through a connecting channel (113). Two ends of the shell (11) respectively have a first opening (114) and a second opening (115) axially penetrating through the shell (11), and the second housing (112) comprises a first securing portion (116) formed therein. The main body (10) is connected to a lock cable (12) which is configured to be wound around an immovable object to achieve the burglarproof effect of the lock. The lock barrel (20) is installed in the first housing (111) of the main body (10), and the lock barrel (20) comprises a lock bolt (21) which is adapted to axially protrude from the first opening (114) to stick out of the shell (11) when the lock is at an unlocked position. The connecting member (30) has a base (31), and an ear portion (32) is formed at an end of the base (31), and an elongated pivot hole (33) vertically penetrates through the ear portion (32). The connecting member (30) is positioned in the connecting channel (113) of the shell (11), and the base (31) is connected to the lock bolt (21) in the connecting channel (113). The first engaging member (40) has a first section (41) and a second section (42) which are connected together to form a designed angle bend, and the first section (41) comprises a second securing portion (43) thereon. When the first engaging member (40) is positioned in the shell (11), the second securing portion (43) is connected to the first securing portion (116) so as to connect the first section (41) of the first engaging member (40) into the second housing (112), and the second section (42) is configured to protrude from the second opening (115) to stick out of the shell (11). The second section (42) has a gradually larger diameter outwardly from the shell (11), and a lateral surface of the second section (42) close to the second engaging member (50) comprises a guiding portion (44), and an engaging block (45) is adapted to protrude from the other lateral surface of the second section (42). In one embodiment, the engaging block (45) is shaped in a triangle wedge. The second engaging member (50) comprises a connecting portion (51) which is configured to pivotally connect to the pivot hole (33) of the connecting member (30) in the connecting channel (113). Also, a lock rod (52) protrudes from an end of the connecting portion (51), and the lock rod (52) is located a position deviated away from a central axis of the connecting portion (51). Moreover, a lateral edge of the lock rod (52) close to the first engaging member (40) comprises a driven portion (53) which is coupled with the guiding portion (44) of the first engaging member (40) such that the lock rod (52) is adapted to be driven by the lock bolt (21) and moved along the lateral surface of the second section (42) which is close to the second engaging member (50). Thus, the lock rod (52) is adapted to be moved by the lock bolt (21) to protrude from or back in the second opening (115) so as to achieve locking and unlocking effects.

In one embodiment, a lateral edge of the second opening (115) comprises an inclined surface (117) to guide the lock rod (52) when protruding from and moving back in the second opening (115).

In another embodiment, the lock cable (12) has a ball head (121) at an end thereof which is configured to pivotally connect to the shell (11) of the main body (10) such that the ball head (121) is adapted to rotate in the shell (11) to enable the lock cable (12) to be positioned in multiple directions.

In still another embodiment, the second securing portion (43) is a hole, and the first securing portion (116) is a bolt which is configured to penetrate through and engage with the second securing portion (43).

In a further embodiment, the lock barrel (20) is a key lock barrel.

In still a further embodiment, the lock bolt (21) of the lock barrel (20) is engaged with the base (31) of the connecting member (30).

In yet a further embodiment, the first section (41) and the second section (42) of the first engaging member (40) are connected together to form 90-degree angle bend.

In a preferred embodiment, the connecting portion (51) is a hook which is adapted to hook on the pivot hole (33) such that the second engaging member (50) is pivotally connected to the ear portion (32) of the connecting member (30) in the shell (11) of the main body (10).

In a particular embodiment, the guiding portion (44) and the driven portion (53) are formed into a step edge and coupled together, such that the second engaging member (50) driven by the lock bolt (21) is adapted to be moved along the second section (42) of the first engaging member (40).

Figure 4:
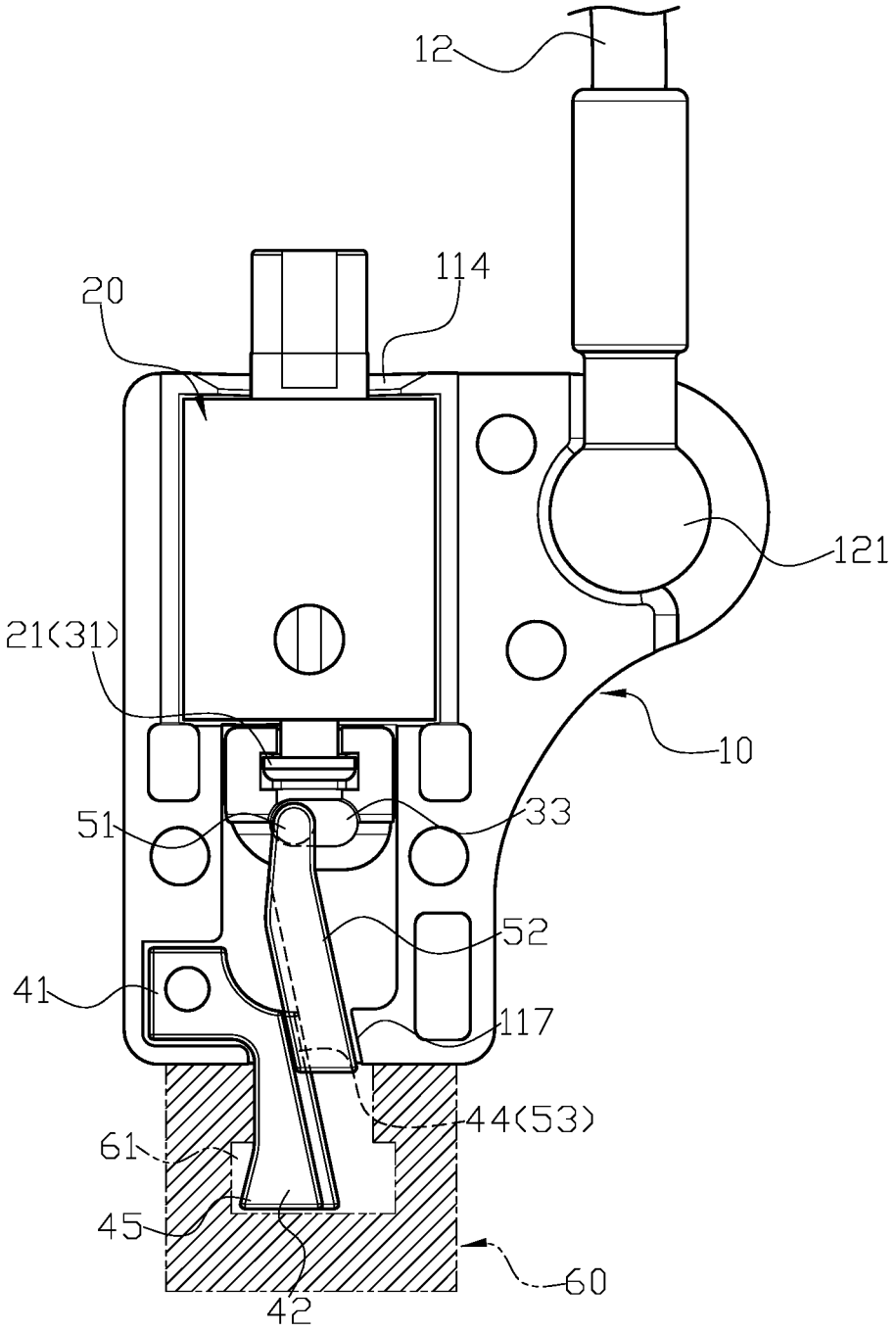
FIG. 4 is a schematic view illustrating the lock of the present invention is used for a first electronic device having a rectangle lock hole.
Figure 5:
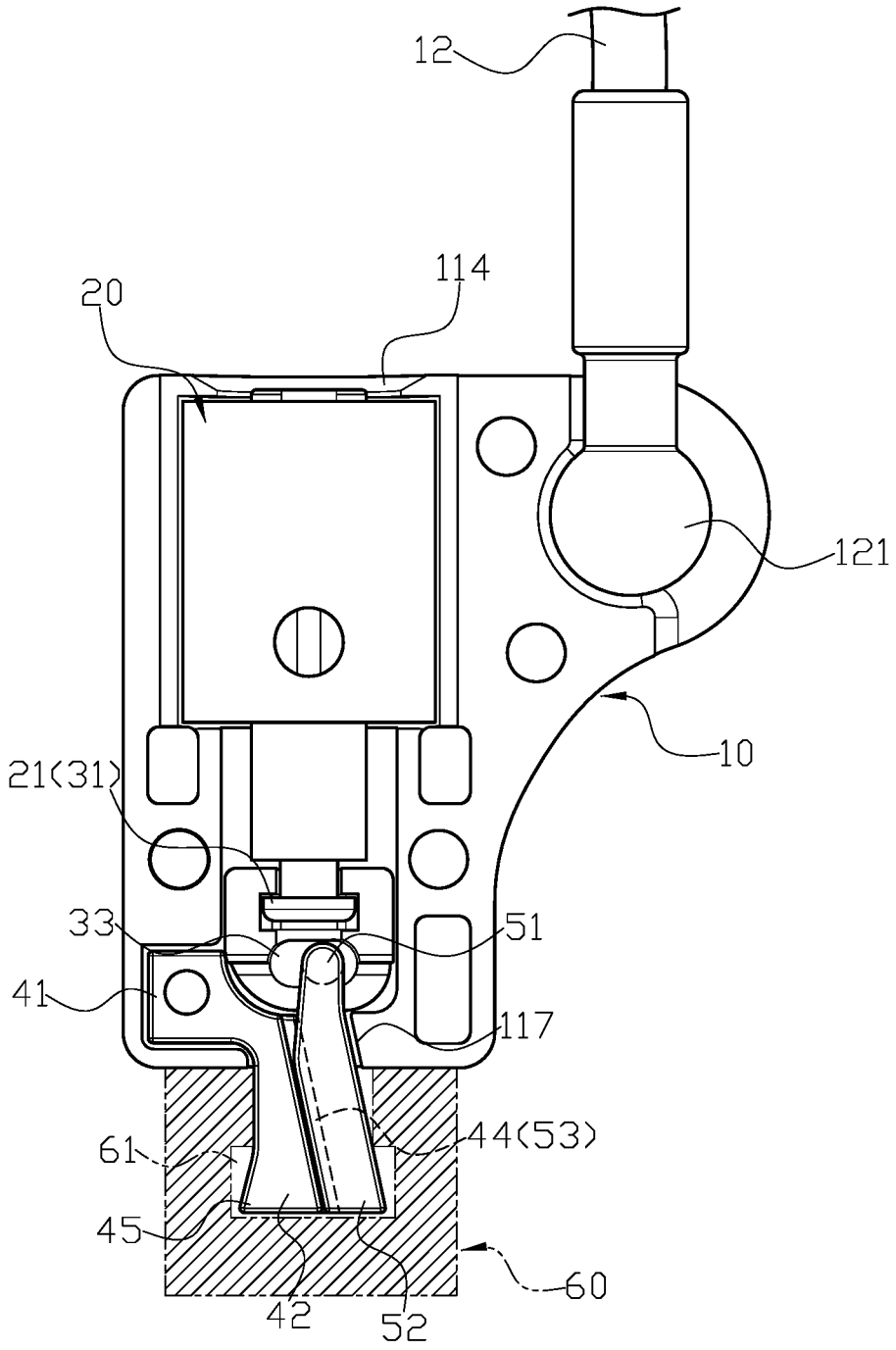
FIG. 5 is a schematic view illustrating the lock of the present invention is applied to the rectangle lock hole of the first electronic device and in a locked position.
Figure 6:
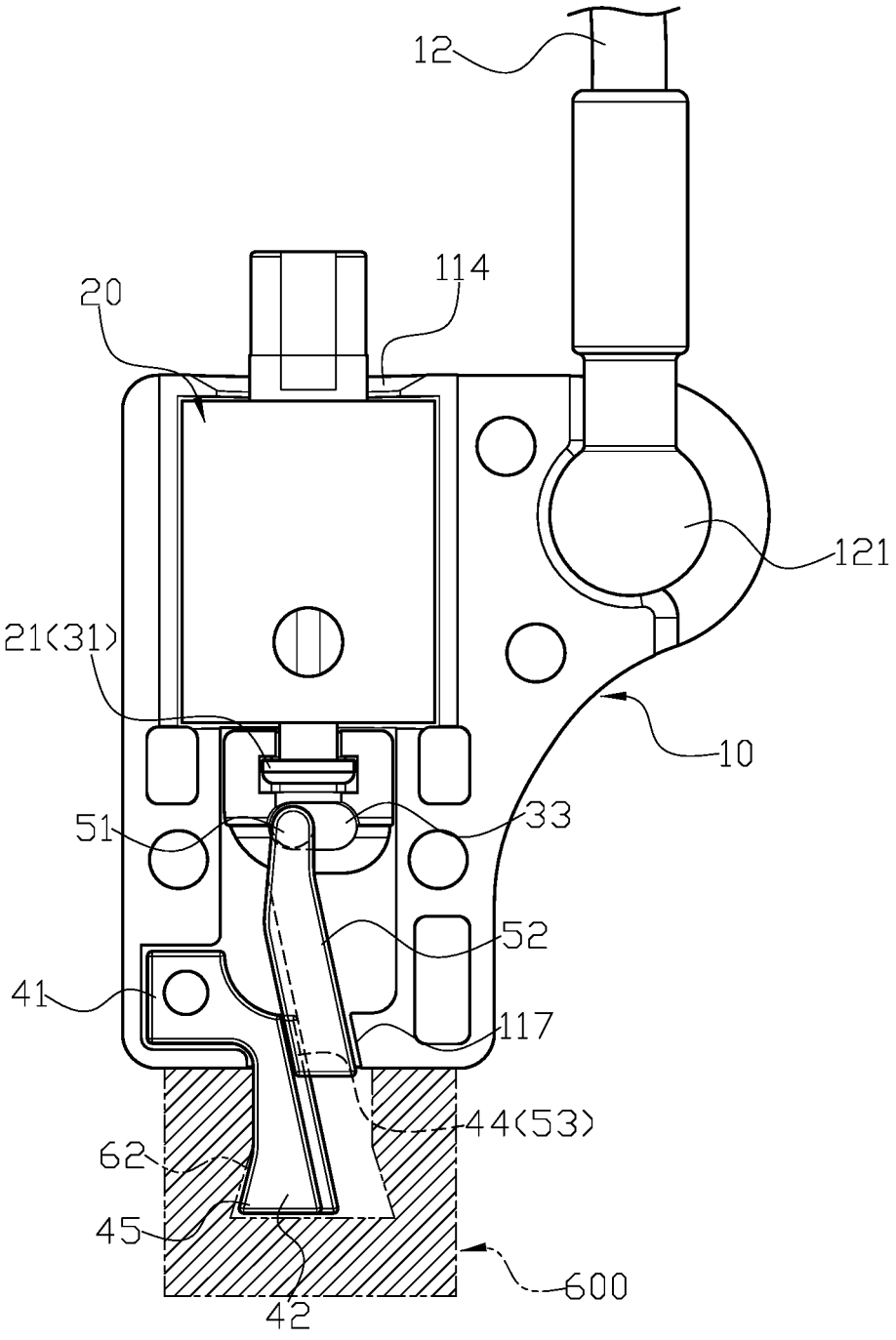
FIG. 6 is a schematic view illustrating the lock of the present invention is used for a second electronic device having a fishtail lock hole.
Figure 7:
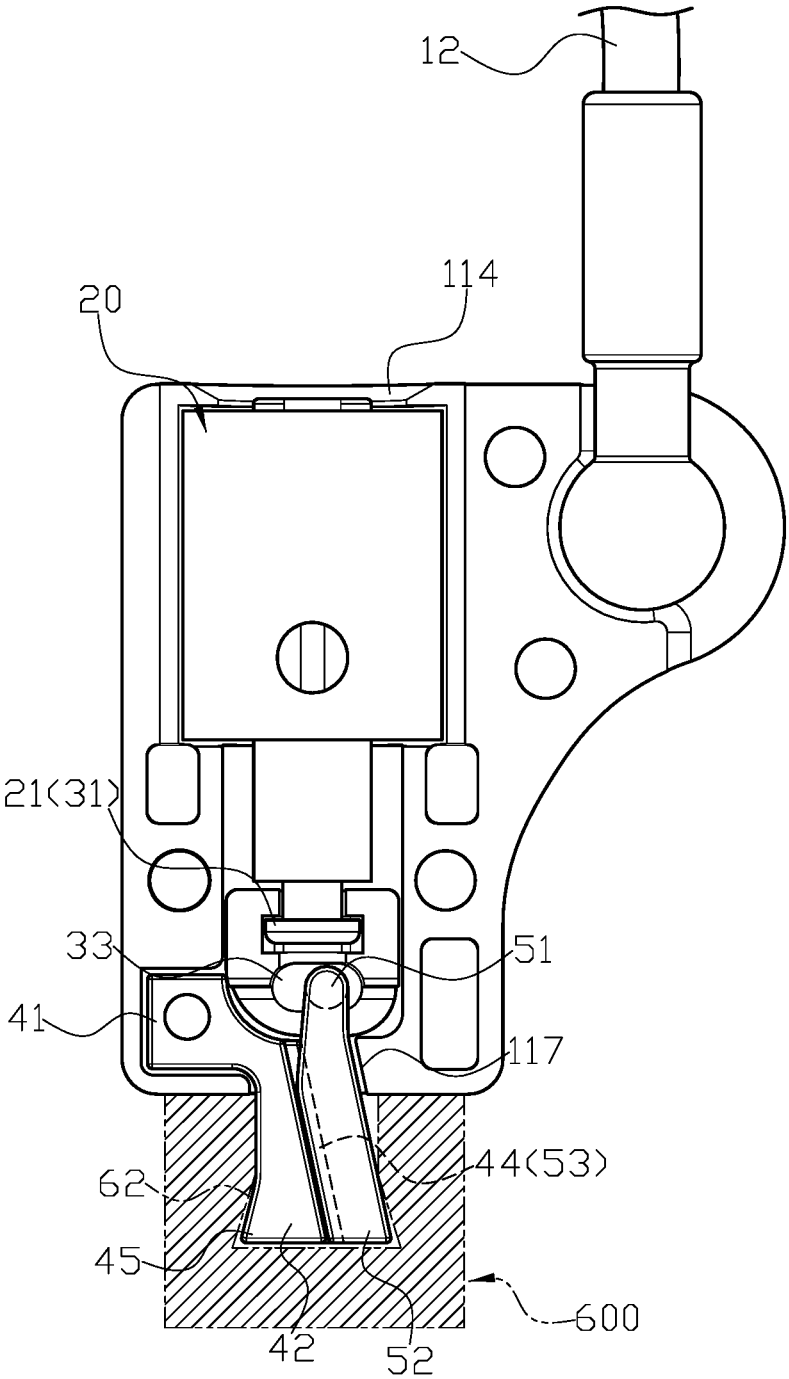
FIG. 7 is a schematic view illustrating the lock of the present invention is applied to the fishtail lock hole of the second electronic device and in the locked position.

In actual application, the first engaging member (40) protruding from the lock of the present invention is configured to insert into a rectangle lock hole (61) of a first electronic device (60) (as shown in FIG. 4), and through pressing the lock bolt (21) of the lock barrel (20), the lock bolt (21) is adapted to push the second engaging member (50) through the connecting member (30) so as to enable the lock rod (52) of the second engaging member (50) to move along the second section (42) of the first engaging member (40) and protrude from the second opening (115). When protruding from the second opening (115), the lock rod (52) is adapted to fill with a gap formed between the first engaging member (40) and the rectangle lock hole (61) such that both of the engaging block (45) of the first engaging member (40) and the lock rod (52) are adapted to hook on the rectangle lock hole (61) so as to achieve the anti-theft effect for the first electronic device (as shown in FIG. 5). Also, through the collaboration of the lock bolt (21), the connecting member (30), the second section (42), the guiding portion (44), the engaging block (45), the lock rod (52), and the driven portion (53), the lock of the present invention can also be applied to a second electronic device (600) having a fishtail lock hole (62) (as shown in FIGS. 6 and 7). In unlocked process, the lock bolt (21) is moved back toward the direction of the first opening (114), and the second engaging member (50) is driven by the connecting member (30) to move back to its initial position, such that the lock rod (52) is moved back in the second opening (115) so as to enable the first engaging member (40) to be detached from the rectangle lock hole (61) or the fishtail lock hole (62), thereby achieving unlocking effect.

Comparing with conventional 3C product locks, the present invention is advantageous because: (i) the lock of the present invention can be used for the electronic product having the rectangle lock hole (61) or the fishtail lock hole (62); and (ii) the lock will not affect the use of the electronic product, and it is easy for a user to operate between the locked and unlocked positions.

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A lock for electronic devices comprising a main body, a lock barrel, a connecting member, a first engaging member, and a second engaging member;

wherein the main body has a shell which comprises two pieces to fit together, and at least an inner surface of the shell has a first housing and a second housing which are communicated through a connecting channel; two ends of the shell respectively have a first opening and a second opening axially penetrating through the shell, and the second housing comprises a first securing portion formed therein; the main body is connected to a lock cable which is configured to be wound around an immovable object to achieve the burglarproof effect of the lock;

wherein the lock barrel installed in the first housing of the main body comprises a lock bolt which is adapted to axially protrude from the first opening to stick out of the shell when the lock is at an unlocked position;

wherein the connecting member has a base, and an ear portion is formed at an end of the base, and an elongated pivot hole vertically penetrates through the ear portion; the connecting member is positioned in the connecting channel of the shell, and the base is connected to the lock bolt in the connecting channel;

wherein the first engaging member has a first section and a second section which are connected together to form a designed angle bend, and the first section comprises a second securing portion thereon; the first engaging member is positioned in the shell, and the second securing portion is connected to the first securing portion, and the first section of the first engaging member is positioned in the second housing, and the second section is configured to protrude from the second opening to stick out of the shell; the second section has a gradually larger diameter outwardly from the shell, and a first lateral surface of the second section close to the second engaging member comprises a guiding portion, and an engaging block is adapted to protrude from a second lateral surface of the second section which is located far from the second engaging member; and wherein the second engaging member comprises a connecting portion which is configured to pivotally connect to the pivot hole of the connecting member in the connecting channel; a lock rod protruding from an end of the connecting portion is located a position deviated away from a central axis of the connecting portion; a lateral edge of the lock rod close to the first engaging member comprises a driven portion which is coupled with the guiding portion of the first engaging member such that the lock rod is adapted to be driven by the lock bolt and moved along the first lateral surface of the second section; the lock rod is adapted to be moved by the lock bolt to protrude from or back in the second opening so as to achieve locking and unlocking effects.

2. The lock for electronic devices of claim 1, wherein a lateral edge of the second opening comprises an inclined surface to guide the lock rod when protruding from and moving back in the second opening.

3. The lock for electronic devices of claim 1, wherein the lock cable has a ball head at an end thereof which is configured to pivotally connect to the shell of the main body such that the ball head is adapted to rotate in the shell to enable the lock cable to be positioned in multiple directions.

4. The lock for electronic devices of claim 1, wherein the second securing portion is a hole, and the first securing portion is a bolt which is configured to penetrate through and engage with the second securing portion.

5. The lock for electronic devices of claim 1, wherein the lock barrel is a key lock barrel.

6. The lock for electronic devices of claim 1, wherein the lock bolt of the lock barrel is engaged with the base of the connecting member.

7. The lock for electronic devices of claim 1, wherein the first section and the second section of the first engaging member are connected together to form 90-degree angle bend.

8. The lock for electronic devices of claim 1, wherein the engaging block is shaped into a triangle wedge.

9. The lock for electronic devices of claim 1, wherein the connecting portion is a hook which is adapted to hook on the pivot hole such that the second engaging member is pivotally connected to the ear portion of the connecting member in the shell of the main body.

10. The lock for electronic devices of claim 1, wherein the guiding portion and the driven portion are formed into a step edge and coupled together, such that the second engaging member driven by the lock bolt is adapted to be moved along the second section of the first engaging member.

* * * * *